US006298576B1

(12) United States Patent
La Gioia

(10) Patent No.: US 6,298,576 B1
(45) Date of Patent: Oct. 9, 2001

(54) CAGE COMPACTOR DRYER APPARATUS FOR TREATING WASTE MATERIALS

(76) Inventor: Antonio La Gioia, Corso Vittoria Colonna 109, 00047 Marino Rome (IT)

( * ) Notice: Subject to any disclaimer, the term of this patent is extended or adjusted under 35 U.S.C. 154(b) by 0 days.

(21) Appl. No.: 09/646,267

(22) PCT Filed: Mar. 24, 1999

(86) PCT No.: PCT/IT99/00071

§ 371 Date: Sep. 15, 2000

§ 102(e) Date: Sep. 15, 2000

(87) PCT Pub. No.: WO99/49269

PCT Pub. Date: Sep. 30, 1999

(30) Foreign Application Priority Data

Mar. 25, 1998 (IT) ..... RM98A0190

(51) Int. Cl.[7] ..... F26B 19/00
(52) U.S. Cl. ..... 34/69; 71/12
(58) Field of Search ..... 34/69, 392, 397, 34/379; 100/48, 50, 73; 71/12; 422/23

(56) References Cited

U.S. PATENT DOCUMENTS

| | | | | |
|---|---|---|---|---|
| 4,177,575 | * | 12/1979 | Brooks | 34/392 |
| 4,374,491 | * | 2/1983 | Brown | 100/73 |
| 4,860,646 | * | 8/1989 | Spiers | 100/48 |
| 5,279,637 | * | 1/1994 | Lynam et al. | 71/12 |
| 5,340,536 | * | 8/1994 | Datar et al. | 422/23 |
| 5,557,873 | * | 9/1996 | Lynam et al. | 34/379 |
| 5,611,268 | * | 3/1997 | Hamilton | 100/50 |
| 5,643,458 | | 7/1997 | Nagaoka | 210/702 |
| 5,720,438 | * | 2/1998 | Devine et al. | 241/21 |
| 5,858,235 | | 1/1999 | Nagaoka | 210/497.01 |
| 6,173,507 | * | 1/2001 | Catallo | 34/397 |

FOREIGN PATENT DOCUMENTS

| | | | |
|---|---|---|---|
| 500 964 A | 4/1952 | (BE) . | |
| 40 32 145 | 1/1992 | (DE) . | |
| 196 27 721 | 1/1998 | (DE) . | |
| 0 663 227 | 7/1995 | (EP) . | |
| 2070767 * | 5/1998 | (ES) | B09B/3/00 |
| 2 656 566 | 7/1991 | (FR) . | |
| 159 525 A | 3/1921 | (GB) . | |

* cited by examiner

*Primary Examiner*—Teresa Walberg
*Assistant Examiner*—Leonid M Fastovsky
(74) *Attorney, Agent, or Firm*—Smith, Gambrell & Russell

(57) ABSTRACT

A cage type compactor and dryer apparatus have a cylindrical body (10) formed by conduits (11) arranged according to the its generatrix lines and run through by a heat transfer fluid intended to heat the waste material contained therein (textile or foodstuff wastes, municipal solid wastes). The individual conduits (11) are spaced apart so as to form vapour outflow paths for the water vapour, having longitudinal dimension corresponding to the whole heating length of the cylindrical body (10). Pressure plates (14) form the mobile bases of the cylindrical body (10) in order to generate the needed axial pressure. Suitable hoops (12) arranged in spaced apart relation constrain said conduits (11) in order to withstand the radial components of the longitudinal forces. The ground connections of the cylindrical body (10), when it is horizontally mounted, are realised by running trolleys (15) aimed at minimising the stresses generated by the temperature variations.

11 Claims, 3 Drawing Sheets

CAGE COMPACTOR DRYER APPARATUS FOR TREATING WASTE MATERIALS

Figure 1:
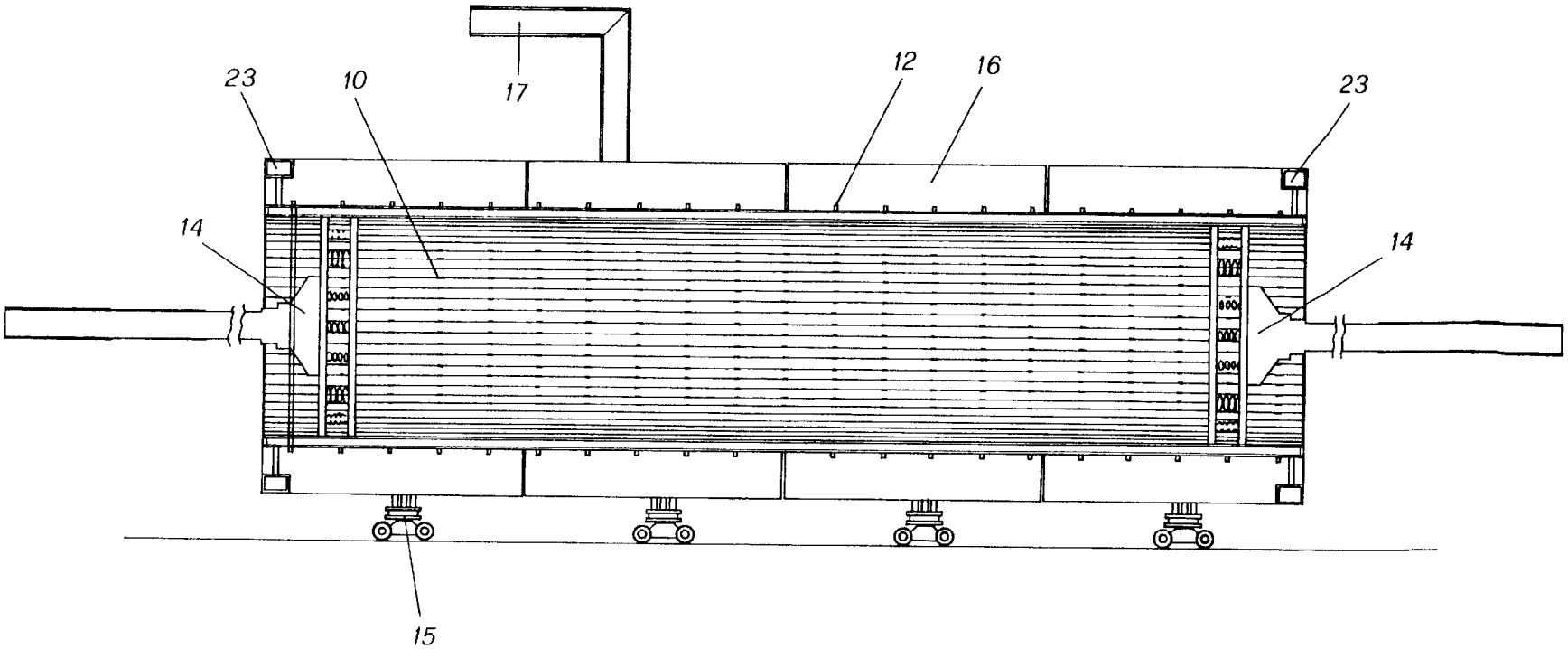

This invention broadly relates to the machines for treating waste materials from industrial manufacturing plants or municipal wastes and more particularly concerns a compactor and dryer apparatus for such waste materials.

The design of an apparatus of this kind should be based upon a plurality of considerations relating to the individual waste materials to be treated, by way of explanation and not by way of limitation, in the working residuals of the foodstuff transformation industry, in the industrial textile wastes, in the differentiated and sorted municipal wastes Particular reference is made to the latter materials, in view of the ever increasing relevance that the disposal of solid waste materials is gaining in the modern society organisation As essential items of this design effort, it worthwhile to mention:

the energetic value of the waste material, the methods to be used for recovering such energetic value, the economic burden connected with such recovery Many variables are to be accounted for in defining the above mentioned items and not all of them appear to be compatible or harmonised with one another, so that all up to now proposed technical approaches appear to be incomplete and inadequate. In any case, two objects of fundamental relevance are to be considered as essential: the volumetric reduction of the waste materials and the inertization of any putrescible component.

The technical procedures up to now applied aiming at compacting the waste materials and at reducing their humidity content by heat and pressure administration are not comparable to the manufacturing requirements of the industrial plants. As a consequence of this, the machines as presently designed are not economically convenient, particularly from an operation view point, because they have characteristics that reduce their working performances.

As an illustrative example of the problems considered and only partially solved in the prior art, reference can be made to Italian Patent No. 1 262 260. This prior art document discloses a horizontal pressing system in which the material to be treated is compacted and dried by removal of the first extrusion water in a container having a proper stopper. Subsequently, the waste material is pushed out of the container near the inlet of a furnace, generally having a parallelepiped shape. A hollow space is provided on the side skirt of the furnace and a heat transfer fluid flows through it in order to transfer heat to the material. Upon loading the furnace, a subsequent heating step is carried out, in order to cause the residual water to vaporise, while the water vapour outflows through discharge openings provided through the side surface of the furnace.

A drawback of this known system is that it is not possible to obtain a regular hydraulic behaviour of the heat transfer fluid which flows within the channel shaped hollow space applied to the side skirt of the furnace, so that the possibilities of thermal exchange are jeopardised.

A further drawback is that also the strength of the furnace body is jeopardised even in respect of very low pressure stresses, due to the openings (having the shape of circular or oval holes) provided in the side surface of the heating chamber for discharging the resulting water vapour.

A still further drawback of the prior art apparatus is that the contact surface between the waste materials to be treated and the heated regions is significantly restricted due to the presence of said side openings, the more so when these openings are provided in large numbers so as to guarantee a complete and continuous discharge of the water vapour so produced. As a matter of fact, a compromise is unavoidably to be arranged between the number and the size of the openings which permit the water vapour to be discharged and the loss of mechanical strength which is caused by such increase in the number and in the size of said openings.

In strict connection with the latter drawback, it is also to be mentioned that the contact surface between the waste materials to be treated and the heated regions of the apparatus is significantly reduced, from an operation efficiency point of view, by the presence of the above mentioned openings, particularly when, as above said, it is desired to assure a complete and continuous outflow of the water vapour by increasing the number and the size of the discharge openings.

Lastly, it is not advisable to disregard the high values of the strains that are developed due to the rectangularly shaped cross-section of the concerned furnace.

It is a broad object of this invention to eliminate the above mentioned drawbacks and particularly to realise a dryer and compactor apparatus such that all problems relating to the hydraulic behaviour of the heat transfer fluid are eliminated and such that not only all problems concerning the heat exchange from the heat transfer fluid to the waste materials to be treated, but also all problems relating to the outflow of the water vapour are unexceptionally solved, without incurring any conflict between the above two requirements.

It is a further object of this invention to eliminate the above mentioned drawbacks by means of a construction of completely novel design, not only adapted to solve the problems of the hydraulic circulation of the heat transfer fluid and of the heat exchange with subsequent outflow of the water vapour produced during operation, but also having characteristics of high strength and perfect resistance to thermal and mechanical stresses as developed during the various operation steps.

In view of the solutions proposed by this invention, it is possible to realise an improved cage like compactor and dryer apparatus for compacting and drying waste materials of any kind, as resulting from processes and industrial and municipal activities, in such amounts as to be utilised in operation cycles involving 70–90 tons of waste material in each working turn, with resulting reduction of the unit cost of the final product It is specific subject-matter of this invention, therefore, a cage like compactor and dryer apparatus for waste materials, such as working residuals of the foodstuff transformation industry, industrial textile wastes, solid differentiated and sorted municipal wastes, comprising container means for containing the waste materials to be treated, means for compacting them, means for heating them, as well as means for discharging the water vapour generated by the heating step, wherein:

said means for containing the waste materials to be treated comprise a cylinder shaped body formed by longitudinal heating conduits run through by a heat transfer fluid, such heating conduits being arranged according to the generatrix lines of said cylinder and in spaced apart relation and having the functions both to act as the bearing structure of the apparatus and to transfer heat from said heat transfer fluid to the waste materials to be treated contained therein, said heating conduits are constrained together by means of retainer hoops, arranged under a pre-established mutual spacing in order to assure stability of the conduits forming said cylinder shaped body under the radial stresses generated by the waste materials being pressed as well as by thermal gradients, said means for compacting the waste materials comprise two oppositely arranged and pressing plates, operating as mobile bases of said cylinder shaped body and acting as pressing pistons, said means for discharging the water vapour generated by the heating step of said waste materials are formed by the longitudinal slots established between said heating conduits arranged according to the generatrix lines of said cylinder shaper body and in spaced apart relation.

In the preferred embodiment, said vapour discharging longitudinal slots are cusp shaped, with variable and outwardly decreasing cross-section and they are in number equal to the number of said longitudinal conduits.

Furthermore, in the preferred embodiment, the concerned apparatus additionally includes a carter of thermoinsulating material, strictly surrounding said cylinder shaped body, designed to collect the water vapour outflowing from said longitudinal slots and acting under vacuum by means of a per se known power operated condenser unit operating in closed circuit arrangement, so as not to have any impact either on the working room, or to external environment.

In addition, said retainer hoops are respectively mounted upon a set of bearing and running trolleys forming a labile iperstatic structure, aimed at minimising the effects of the stresses generated by any high thermal gradients developed by the heating treatment, as well as the effects caused by the pressure forces generated by said two pressing plates.

Further details and advantages of this invention will be evident from the following specification by referring to the enclosed drawings wherein the preferred embodiment is shown by way of illustration and not by way of limitation.

Figure 2:
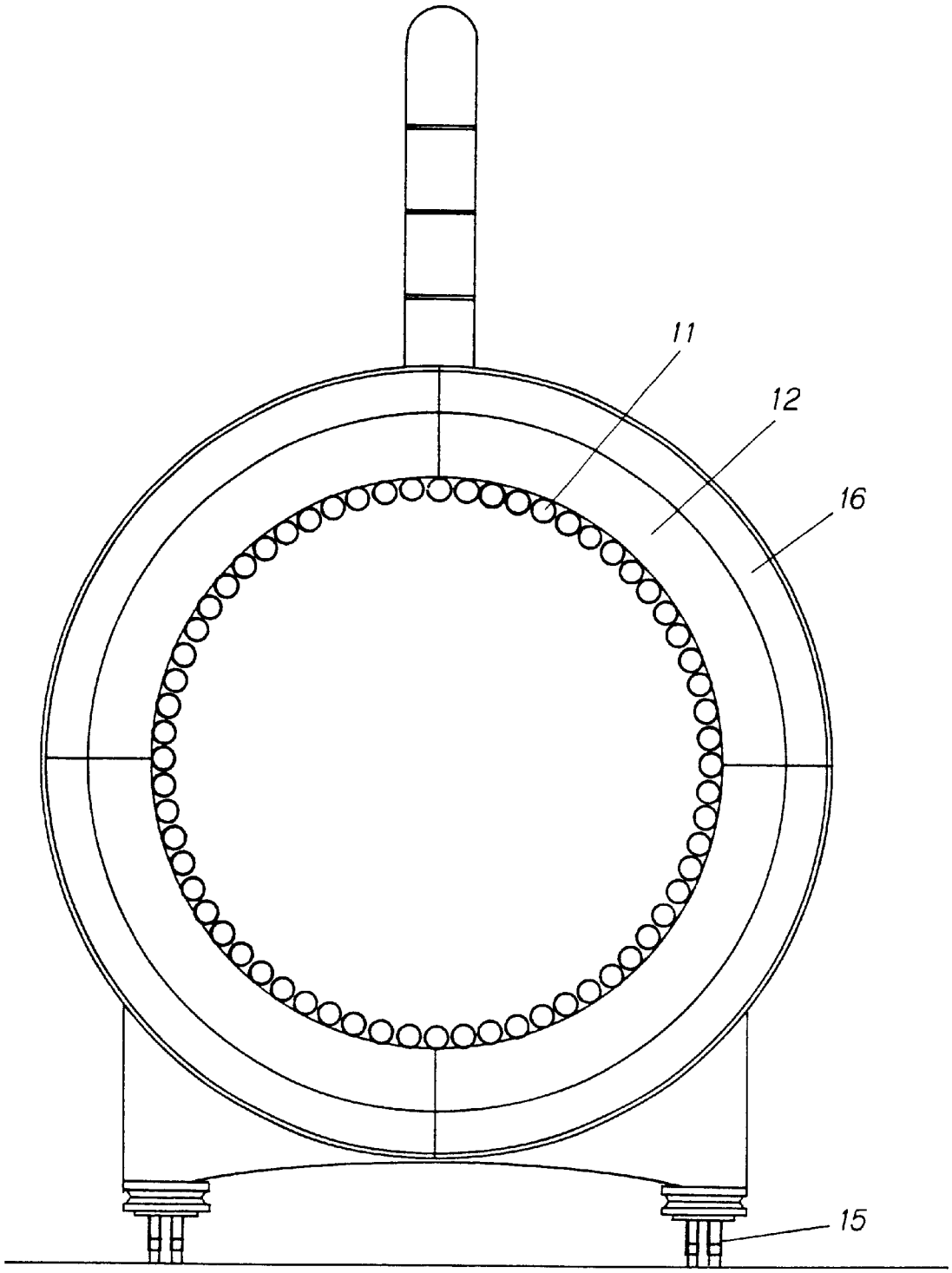
Figure 3:
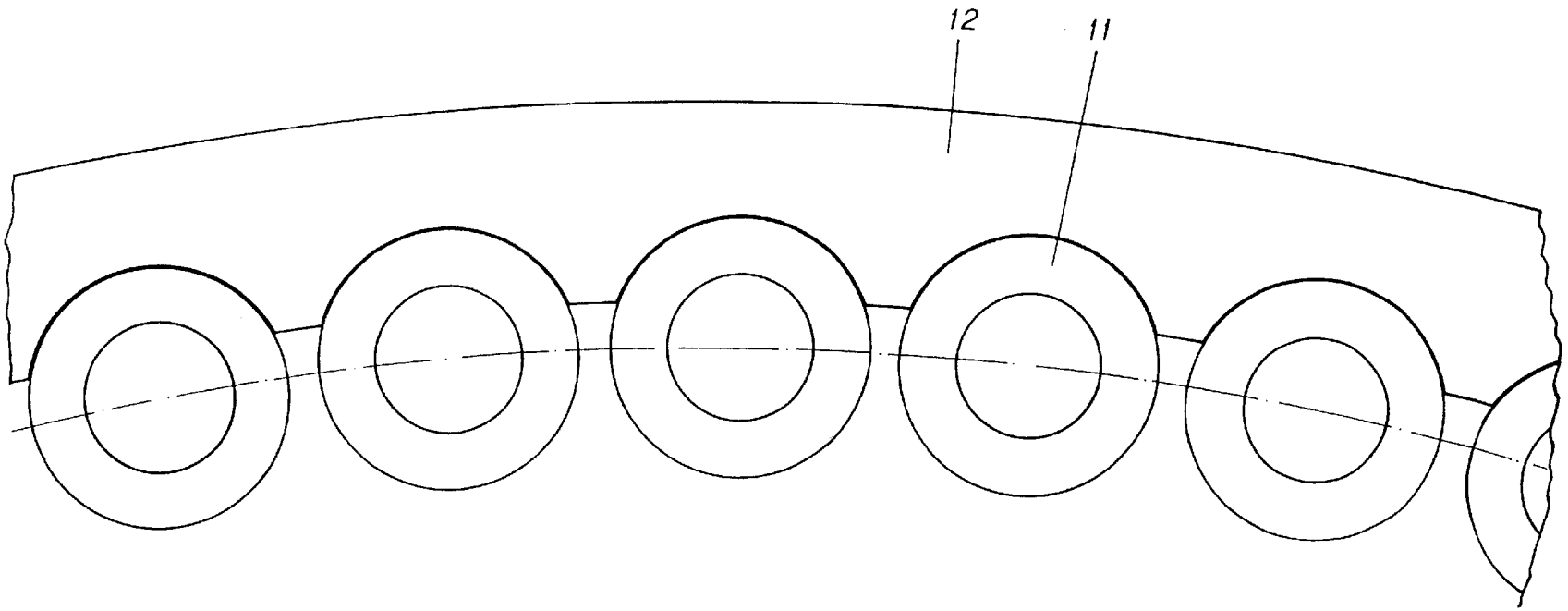

In the drawings:

FIG. 1 is a schematic side elevation cross-section view of an apparatus according to this invention, FIG. 2 is a front elevation cross-section view of the apparatus of FIG. 1, FIG. 3 is a detail view of the conduit retainer hoop.

By referring now to the drawings, it can be observed that the compactor and dryer apparatus according to this invention comprises a cylinder shaped body 10 formed by a number of conduits 11 arranged according to the generatrix lines of the cylinder and run through by a heat transfer fluid. The assembly of said conduits 11, therefore, defines an internal cylindrical room receiving the waste materials to be compacted and dried. From a practical view point, this compactor and dryer apparatus operates as a furnace the side wall of which is divided into a plurality of conduits 11 constrained together and arranged in spaced apart relation according to an ideal circumference and having the special function to transfer heat to the waste materials contained therein. Furthermore, in view of the good properties of all tubular bodies to operate as beams, they are so sized and constrained as to be adapted to also act as a bearing structure for the waste materials to be treated and to withstand the pressure and thermal stresses generated during operation thereof.

The structure and operation details of the concerned apparatus will now be described by referring to the Figures.

The conduits 11 forming the cylinder shaped body 10 are run through by a heat transfer fluid at a temperature of 190–210° C.; they form the containment structure of the waste materials to be treated and are constrained together by means of a number of retainer hoops 12, arranged at preestablished mutual distances in order to assure the stability of the conduits forming the cylinder shaped body under the radial stress generated by the pressed material as well as by the thermal gradients due to the heating operation. These constraint members 12 have, at their intrados in contact with said conduits 11, a corresponding number of seats designed according to a capital omega profile within which said conduits are securely mounted.

The axial longitudinal pressing force needed for compacting the waste materials contained within the cylinder shaped body 10 is exerted on the opposite bases of the cylindrical body by two sturdy plates 14, suitably shaped with a crenelated perimetral profile designed to be inserted into the inner room of the cylindrical body and particularly with the cusps existing between the crenels inserted into the cusp shaped seats formed between the conduits, as it will be better understood hereinafter.

The conduits 11 are in communication with inlet and outlet headers 23 for the diathermal fluid and they are connected by means of suitable hoses (not shown) to the outer portion of said cylinder shaped body of the cage like compactor and dryer apparatus, so as not to impede the movements of said two pressure plates 14, operating as pistons within said cylinder body 10.

It can be observed that, thanks to the structure as heretofore explained, the heat transfer fluid follows a well defined hydraulic behaviour within each of said conduits 11 and it is possible to select such values of the flow rates as to obtain high heat exchange rates with the waste materials being treated.

The cage like cylinder shaped body 10 having said integrally coupled retainer hoops 12 is mounted upon ground mountings consisting in running trolleys 15 suitably arranged as to realise a labile iperstatic structure, adapted to minimise the stress effects due to the high thermal gradients developed during the heating operation, as well as the effects due to the longitudinal pressure forces generated by the two pressing plates 14.

The particular geometric arrangement of the conduits 11, which operate, as above explained, both as a heat source and as a containment structure is to be considered as a substantial aspect of this invention. Conduits 11 are arranged according to the generatrix lines of the cylinder shaped body and they are suitably spaced from one another so as to leave a set of longitudinal slots which, therefore, are in a number equal to the number of conduits 11 and are cusp shaped, have been found to be extremely effective not only as an outflow path for the water vapour produced by the heating operation of the waste materials, but also as an auxiliary element in the heat exchange between conduits 11 and said waste materials being treated. The slots apparently have a variable and outwardly decreasing cross-section, as to offer to the waste materials being pushed by the pressure generated by the pressing plates 14 a gradual and ever increasing resistance, that will end only when the pressure forces stably reach their design values.

These features not only assure an effective outflow of the water vapour, because the above mentioned slots considered as a whole develop an outflow area even equal to 2–3 square metres, without incurring a weakening effect of the side wall of the cylinder shaped body, but also assure non-leaking of the waste materials through the slots during their treatment.

By this structure, the evaporation surface of the waste materials being treated in direct contact with the conduits, which is a substantial variable in respect of the energetic efficiency of the whole apparatus, is positioned just near the above mentioned outflow paths of the water vapour, as defined by the spatial gaps existing between said conduits, and it is larger (even twice as large) than the one that can be obtained with other geometric shapes of the furnace body (for instance parallelepiped or prismatic shape) having the same heating length.

The increased contact surface between the conduits of the compactor and dryer apparatus according to this invention and the waste materials to be treated allows significant reductions to be obtained in the heating and cooling times of the waste materials being treated, with resulting favourable effect on the economic balance of the operation course for the whole apparatus, which also includes central heating and cooling equipment.

The relation which is established between the surface of said conduits 11 and the waste materials to be treated is such that the attrition forces acting all over the length of the apparatus between said conduits and the waste materials under pressure do not hinder a regular longitudinal distribution of the pressure effects on the volume reduction of the waste materials being treated.

The cross-section configuration of the cage like cylinder shaped body 10 also facilitates the extraction operation of the compacted and dried product after treatment, in view of the fact that the heating surface of said conduits offers built-in discontinuities between the individual generatrix lines, with respect to the continuous surface of the compacted and dried material.

Furthermore, it appears to be convenient to remark that the pressing plates are shaped with a saddle or creneled profile, so as to support the conduits even when the developed forces or moments do not operate on radial planes starting from the centreline of the cylinder shaped body 10.

Lastly, the assembly of the cylinder shaped body 10 is enclosed by a carter member 16 of thermoinsulating material, acting as a collector header for the water vapour outflowing through the above said outflow paths, said water vapour being sucked through a discharge conduit 17 by a power operated condenser unit operating in closed circuit arrangement, so that the concerned plant has no impact either on the working room, or to external environment.

The compactor and dryer apparatus as heretofore described can be manufactured with materials having low to intermediate mechanical strength, while assuring that, in contrast with materials of high mechanical strength, all problems relating to general corrosion effects can be controlled simply by suitably oversizing the concerned structures.

From this view point, it can be understood that surface treatments adapted to impart abrasion resistance to the conduits are made possible by the feasibility to employ low alloyed steels.

It can also be understood that any need to increase the axial pressure during the subsequent extraction stage of the treated material appears to be perfectly compatible with the structure of the compactor and dryer apparatus according to this invention, because the conduits can act as high strength beams, even if they have a small thickness.

The preferred embodiment of this invention has been hereinbefore explained, but it should be understood that those skilled in the art can made variations and changes therein without departing from the scope of this invention.

What is claimed is:

1. A cage type compactor and dryer apparatus for waste materials, comprising container means for containing the waste materials to be treated, means for compacting them, means for heating them, as well as means for discharging the water vapor generated by the heating step, characterised in that:

said means for containing the waste materials to be treated comprise a cylinder shaped body (10) formed by longitudinal heating conduits (11) run through by a heat transfer fluid, such heating conduits being arranged according to the generatrix lines of said cylinder and in spaced apart relation and having the functions both to act as a bearing structure of the apparatus and to transfer heat from said heat transfer fluid to the waste materials to be treated contained therein, said heating conduits (11) are constrained together by means of retainer hoops (12), arranged under a pre-established mutual spacing in order to assure stability of the conduits forming said cylinder shaped body (1) under the radial generated by the waste materials being pressed as well as thermal gradients, said means for compacting the waste materials comprise two sturdy oppositely arranged and pressing plates (14), operating as mobile bases of said cylinder shaped body (10) and acting as pressing pistons, said means for discharging the water vapour generated by the heating of said waste materials are formed by the longitudinal slots estbalished between said heating conduits arranged according to the generatrix lines of cylinder shaped body (10) and in spaced apart relation.

2. A cage type compactor and dryer apparatus according to claim 1, characterised in that said vapour discharging longitudinal slots are cusp shaped, with variable and outwardly decreasing cross-section.

3. A cage type compactor and dryer apparatus according to claim 1, characterised in that said vapour discharging longitudinal slots are in number equal to the number of said longitudinal conduits (11) forming said containment cylinder shaped body (10).

4. A cage type compactor and dryer apparatus according to claim 1, characterised in that said sturdy plates (14) are shaped with crenelated perimetral profile so as to be inserted into the inner room of the cylinder shaped body and particularly with the cusps existing between the crenels inserted into the cusp shaped seats formed between the conduits and to form a support for said conduits (11) even when the developed forces or moments do not operate on radial planes starting from the centreline of the cylinder shaped body (10).

5. A cage type compactor and dryer apparatus according to claim 1, characterised in that it additionally includes a carter (16) of thermoinsulating material, strictly surrounding said cylinder shaped body (10), designed to collect the water vapour outflowing from said longitudinal slots and acting under vacuum by means of a power operated condenser unit operating in closed circuit arrangement, so as to have no impact either on the working room, or to external environment.

6. A cage type compactor and dryer apparatus according to claim 5, characterised in that said retainer hoops (12) are respectively mounted upon a set of bearing and running trolleys (15) forming a labile iperstatic structure, aimed at minimising the effects of the stresses generated by any high thermal gradients developed by the heating treatment, as well as the effects caused by the pressure forces generated by said two pressing plates (14).

7. A cage type compactor and dryer apparatus according to claim 1, characterised in that said retainer hoops (12) for constraining the longitudinal conduits (11) have, at their intrados in contact with said conduits (11), a profile strictly corresponding to the profile of said conduits, so as to form ideal seats for each of them.

8. A cage type compactor and dryer apparatus according to claim 1, characterised in that it further comprises inlet and outlet headers (23) for the diathermal fluid flowing in said conduits (11) which form said cylinder shaped body (10) and in that said headers (23) are connected by means of hoses to the outer portion of said conduits, so as not to impede the movements of said two opposite pressure plates (14).

9. A cage type compactor and dryer apparatus according to claim 1, characterised in that said heat transfer fluid has a temperature of 190–210° C.

10. A cage type compactor and dryer apparatus according to claim 1, characterised in that it is manufactured with materials having low to intermediate mechanical strength, so that all problems relating to general corrosion effects can be controlled by oversizing the thickness of the components of the cage like cylinder shaped body.

11. A cage type compactor and dryer apparatus according to claim 1, characterised in that it is manufactured with low alloyed steels, such that it can be subjected to surface treatments adapted to impart abrasion resistance to said conduits.

* * * * *